US010102864B2

(12) United States Patent
Keiler et al.

(10) Patent No.: US 10,102,864 B2
(45) Date of Patent: Oct. 16, 2018

(54) METHOD AND APPARATUS FOR CODING OR DECODING SUBBAND CONFIGURATION DATA FOR SUBBAND GROUPS

(71) Applicant: Dolby Laboratories Licensing Corporation, San Francisco, CA (US)

(72) Inventors: Florian Keiler, Hannover (DE); Sven Kordon, Wunstorf (DE); Alexander Krueger, Hannover (DE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/508,444

(22) PCT Filed: Aug. 19, 2015

(86) PCT No.: PCT/EP2015/069077
§ 371 (c)(1),
(2) Date: Mar. 2, 2017

(87) PCT Pub. No.: WO2016/034420
PCT Pub. Date: Mar. 10, 2016

(65) Prior Publication Data

US 2017/0243592 A1 Aug. 24, 2017

(30) Foreign Application Priority Data

Sep. 2, 2014 (EP) ..... 14306347

(51) Int. Cl.
*G10L 19/00* (2013.01)
*G10L 19/02* (2013.01)
*G10L 19/002* (2013.01)

(52) U.S. Cl.
CPC ..... *G10L 19/0204* (2013.01); *G10L 19/002* (2013.01)

(58) Field of Classification Search
USPC ..... 704/500–504
See application file for complete search history.

(56) References Cited

U.S. PATENT DOCUMENTS 8,874,450 B2 * 10/2014 Peng ..... G10L 19/24 704/205
2007/0016412 A1 1/2007 Mehrotra
(Continued)

FOREIGN PATENT DOCUMENTS

WO 2016/001355 1/2016

OTHER PUBLICATIONS

Traunmuller, Hartmut "Analytical Expressions for the Tonotopic Sensory Scale" The Journal of the Acoustical Society of America, Feb. 20, 1990, pp. 97-100.
(Continued)

*Primary Examiner* — Leonard Saint Cyr

(57) ABSTRACT

For an efficient encoding of subband configuration data the first, penultimate and last subband groups are treated differently than the other subband groups. Further, subband group bandwidth difference values are used in the encoding. The number of subband groups $N_{SB}$ is coded using a fixed number of bits representing $N_{SB}-1$. The bandwidth value $B_{SB}[1]$ of the first subband group is coded using a unary code representing $B_{SB}[1]-1$. No bandwidth value $B_{SB}[g]$ is coded for the last subband $g=N_{SB}$. For subband groups $g=2, \ldots, N_{SB}-2$ bandwidth difference values $\Delta B_{SB}[g]=B_{SB}[g]-B_{SB}[g-1]$ are coded using a unary code, and the bandwidth difference value $\Delta B_{SB}[N_{SB}-1]$ for subband group $g=N_{SB}-1$ is coded using a fixed number of bits.

12 Claims, 4 Drawing Sheets

(56) References Cited

U.S. PATENT DOCUMENTS

2009/0240491 A1 9/2009 Reznik
2012/0323582 A1* 12/2012 Peng ..... G10L 19/24
704/500

OTHER PUBLICATIONS

Zwicker, E. et al Psychoacoustics: Facts and Models. Springer Series in Information Sciences. Springer, Second Updated Edition, 1999.

* cited by examiner

METHOD AND APPARATUS FOR CODING OR DECODING SUBBAND CONFIGURATION DATA FOR SUBBAND GROUPS

TECHNICAL FIELD

The invention relates to a method and to an apparatus for coding or decoding subband configuration data for subband groups valid for one or more frames of an audio signal.

BACKGROUND

In audio applications and in particular in audio coding often a processing of subband signals is performed. Efficient filter banks are realised by using quadrature mirror filters QMF, or fast Fourier transform FFT use subbands with equal bandwidth. However, in audio applications and in audio coding it is advantageous that the used subbands have different bandwidths adapted to the psycho-acoustic properties of human hearing. Therefore in audio processing a number of subbands from the original filter bank are combined so as to form an adapted filter bank with subbands having different bandwidths. Alternatively, a group of adjacent subbands from the original filter bank is processed using the same parameters. In audio coding quantised parameters for each subband group are stored or transmitted.

There exist different scales (e.g. Bark scale) for the frequency axis that approximate the properties of human hearing, e.g.:

H. Traunmüller, "Analytical expressions for the tonotopic sensory scale", The Journal of the Acoustical Society of America, vol. 88(1), pp. 97-100, 1990.

E. Zwicker, and H. Fastl, "Psychoacoustics: Facts and Models", Springer series in information sciences, Springer, second updated edition, 1999.

SUMMARY OF INVENTION

If groups of combined subbands are used, the corresponding subband configuration applied at encoder side must be known to the decoder side.

A problem to be solved by the invention is to reduce the required number of bits for defining a subband configuration. This problem is solved by the methods disclosed in claims 1 and 5. Apparatus which utilise these methods are disclosed in claims 3 and 7.

Advantageous additional embodiments of the invention are disclosed in the respective dependent claims.

For an efficient encoding of subband configuration data the first, penultimate and last subband groups are treated differently than the other subband groups. Further, subband group bandwidth difference values are used in the encoding.

In principle, the inventive coding method is suited for coding subband configuration data for subband groups valid for one or more frames of an audio signal, wherein each subband group is equal to one original subband or is a combination of two or more adjacent original subbands, the bandwidth of a following subband group is greater than or equal to the bandwidth of a current subband group, and the number of original subbands is predefined, said method including:

coding a number of subband groups $N_{SB}$ with a fixed number of bits representing $N_{SB}-1$;

if $N_{SB}>1$, coding for a first subband group g=1 a bandwidth value $B_{SB}[1]$ with a unary code representing $B_{SB}[1]-1$;

if $N_{SB}=3$, in addition to coding said bandwidth value $B_{SB}[1]$ for said first subband group g=1, coding for subband group g=2 a bandwidth difference value $\Delta B_{SB}[2]=B_{SB}[2]-B_{SB}[1]$ with a fixed number of bits;

if $N_{SB}>3$, in addition to coding said bandwidth value $B_{SB}[1]$ for said first subband group g=1, coding for subband groups g=2, . . . , $N_{SB}-2$ a corresponding number of bandwidth difference values $\Delta B_{SB}[g]=B_{SB}[g]-B_{SB}[g-1]$ with a unary code, and coding for subband group $g=N_{SB}-1$ a bandwidth difference value $\Delta B_{SB}[N_{SB}-1]=B_{SB}[N_{SB}-1]-B_{SB}[N_{SB}-2]$ with a fixed number of bits, wherein a bandwidth value for a subband group is expressed as number of adjacent original subbands, and wherein for subband $g=N_{SB}$ no corresponding value is included in the coded subband configuration data.

In principle the inventive coding apparatus is suited for coding subband configuration data for subband groups valid for one or more frames of an audio signal, wherein each subband group is equal to one original subband or is a combination of two or more adjacent original subbands, the bandwidth of a following subband group is greater than or equal to the bandwidth of a current subband group, and the number of original subbands is predefined, said apparatus including means adapted to:

coding a number of subband groups $N_{SB}$ with a fixed number of bits representing $N_{SB}-1$;

if $N_{SB}>1$, coding for a first subband group g=1 a bandwidth value $B_{SB}[1]$ with a unary code representing $B_{SB}[1]-1$;

if $N_{SB}=3$, in addition to coding said bandwidth value $B_{SB}[1]$ for said first subband group g=1, coding for subband group g=2 a bandwidth difference value $\Delta B_{SB}[2]=B_{SB}[2]-B_{SB}[1]$ with a fixed number of bits;

if $N_{SB}>3$, in addition to coding said bandwidth value $B_{SB}[1]$ for said first subband group g=1, coding for subband groups g=2, . . . , $N_{SB}-2$ a corresponding number of bandwidth difference values $\Delta B_{SB}[g]=B_{SB}[g]-B_{SB}[g-1]$ with a unary code, and coding for subband group $g=N_{SB}-1$ a bandwidth difference value $\Delta B_{SB}[N_{SB}-1]=B_{SB}[N_{SB}-1]-B_{SB}[N_{SB}-2]$ with a fixed number of bits, wherein a bandwidth value for a subband group is expressed as number of adjacent original subbands, and wherein for subband $g=N_{SB}$ no corresponding value is included in the coded subband configuration data.

In principle, the inventive decoding method is suited for decoding coded subband configuration data for subband groups valid for one or more frames of a coded audio signal, which subband configuration data are data which were coded according to the above coding method and which were arranged as a sequence of said coded number of subband groups and said coded bandwidth value for said first subband group and possibly one or more coded bandwidth difference values, wherein each subband group is equal to one original subband or is a combination of two or more adjacent original subbands, the bandwidth of a following subband group is greater than or equal to the bandwidth of a current subband group, and the number of original subbands $N_{FB}$ is predefined, said method including:

determining the number of subband groups $N_{SB}$ by adding '1' to a decoded version of a received coded number of subband groups;

determining for the first subband group g=1 a bandwidth value $B_{SB}[1]$ by adding '1' to a decoded version of the corresponding received coded bandwidth value;

if $N_{SB}=3$, in addition to determining said bandwidth value $B_{SB}[1]$ for said first subband group g=1, decoding for subband group g=2 from the received coded version of bandwidth difference value $\Delta B_{SB}[2]$ a bandwidth value $B_{SB}[2]=\Delta B_{SB}[2]+B_{SB}[1]$;

if $N_{SB}>3$, in addition to determining said bandwidth value $B_{SB}[1]$ for said first subband group g=1, decoding for subband groups g=2, . . . , $N_{SB}-2$ from the received coded version of bandwidth difference values $\Delta B_{SB}[g]$ bandwidth values $B_{SB}[g]=\Delta B_{SB}[g]+B_{SB}[g-1]$, and decoding for subband group $g=N_{SB}-1$ from the received coded version of bandwidth difference value $\Delta B_{SB}[N_{SB}-1]$ a bandwidth value $B_{SB}[N_{SB}-1]=\Delta B_{SB}[N_{SB}-1]+B_{SB}[N_{SB}-2]$.

determining the bandwidth value $B_{SB}[N_{SB}]$ for subband $g=N_{SB}$ by subtracting the bandwidths $B_{SB}[1]$ to $B_{SB}[N_{SB}-1]$ from $N_{FB}$, wherein a bandwidth value for a subband group is expressed as number of adjacent original subbands.

In principle the inventive decoding apparatus is suited for decoding coded subband configuration data for subband groups valid for one or more frames of a coded audio signal, which subband configuration data are data which were coded according to the above coding method and which were arranged as a sequence of said coded number of subband groups and said coded bandwidth value for said first subband group and possibly one or more coded bandwidth difference values, wherein each subband group is equal to one original subband or is a combination of two or more adjacent original subbands, the bandwidth of a following subband group is greater than or equal to the bandwidth of a current subband group, and the number of original subbands $N_{FB}$ is predefined, said apparatus including means adapted to:

determining the number of subband groups $N_{SB}$ by adding '1' to a decoded version of a received coded number of subband groups;

determining for the first subband group g=1 a bandwidth value $B_{SB}[1]$ by adding '1' to a decoded version of the corresponding received coded bandwidth value;

if $N_{SB}=3$, in addition to determining said bandwidth value $B_{SB}[1]$ for said first subband group g=1, decoding for subband group g=2 from the received coded version of bandwidth difference value $\Delta B_{SB}[2]$ a bandwidth value $B_{SB}[2]=\Delta B_{SB}[2]+B_{SB}[1]$;

if $N_{SB}>3$, in addition to determining said bandwidth value $B_{SB}[1]$ for said first subband group g=1, decoding for subband groups g=2, . . . , $N_{SB}-2$ from the received coded version of bandwidth difference values $\Delta B_{SB}[g]$ bandwidth values $B_{SB}[g]=\Delta B_{SB}[g]+B_{SB}[g-1]$, and decoding for subband group $g=N_{SB}-1$ from the received coded version of bandwidth difference value $\Delta B_{SB}[N_{SB}-1]$ a bandwidth value $B_{SB}[N_{SB}-1]=\Delta B_{SB}[N_{SB}-1]+B_{SB}[N_{SB}-2]$.

determining the bandwidth value $B_{SB}[N_{SB}]$ for subband $g=N_{SB}$ by subtracting the bandwidths $B_{SB}[1]$ to $B_{SB}[N_{SB}-1]$ from $N_{FB}$, wherein a bandwidth value for a subband group is expressed as number of adjacent original subbands.

BRIEF DESCRIPTION OF DRAWINGS

Exemplary embodiments of the invention are described with reference to the accompanying drawings, which show in.

DESCRIPTION OF EMBODIMENTS

Even if not explicitly described, the following embodiments may be employed in any combination or sub-combination.

Figure 1:
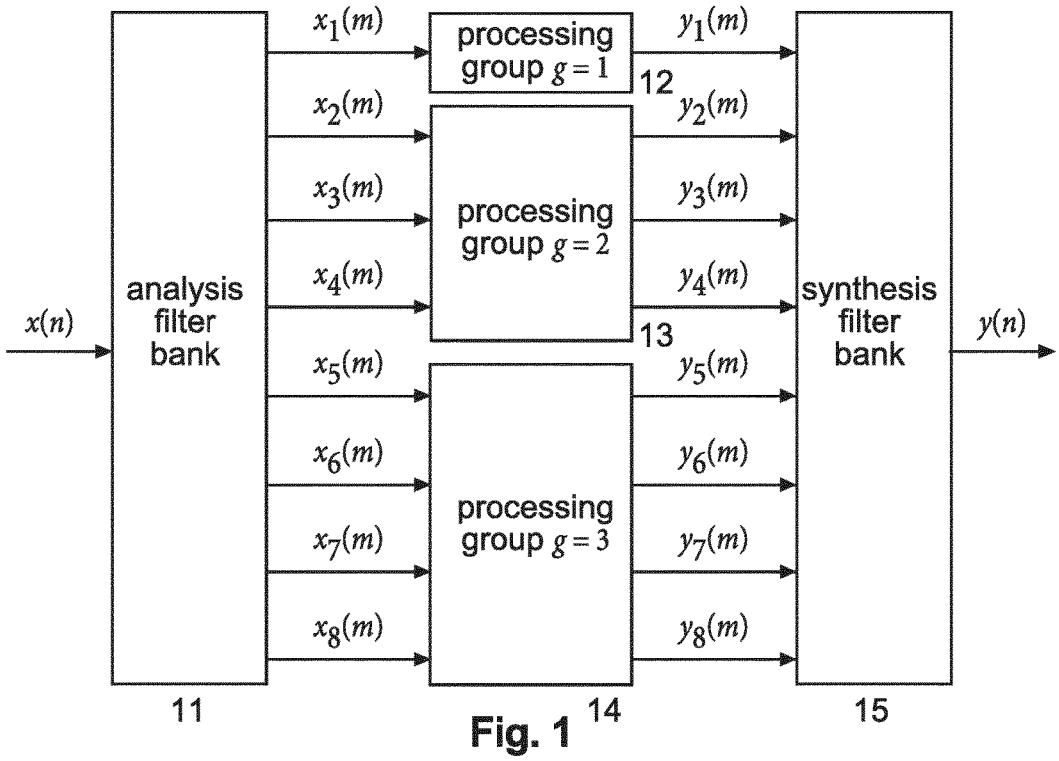
FIG. 1 example processing of subband groups for $N_{FB}=8$ original subbands and $N_{SB}=3$ subband groups.

FIG. 1 shows an example subband processing including an original analysis filter bank 11 with 8 subbands and the use of 3 subband group blocks 12 to 14, g=1, 2, 3, for the processing. x(n) denotes the audio input signal with the discrete time sample index n. $x_1(m)$, . . . , $x_8(m)$ are the subband signals with sample index m which is generally defined at a reduced sampling rate compared to that of the audio input signal. Within each subband group 12 to 14 the subband signals are processed using the same parameters. The processed subband signals $y_1(m)$, . . . , $y_8(m)$ are then fed into a synthesis filter bank 15 that reconstructs the broadband output audio signal y(n) at the original sampling rate.

The invention deals with the efficient coding of subband configurations, which includes the number of subband groups and the mapping of original subbands to subband groups. In case an audio encoder can operate with different subband configurations (i.e. different number of subbands and different bandwidths of these subbands), these subband configurations are transferred or transmitted to the audio decoder side.

In a different embodiment the subband configuration is changing over time (for example dependent on an analysis of the audio input signal).

It has to be ensured in both cases that both encoder and decoder use the same subband configuration. For streaming formats this kind of information is sent at the beginning of each streaming block where a decoding can be started.

It is assumed that the configuration and operation mode (e.g. QMF) of the original analysis filter bank 11 in the encoder is fixed and is known to the decoder. The number of subbands of the analysis filter bank 11 is denoted by $N_{FB}$ and needs not be transferred to decoder side. The number of combined subbands or subband groups used for the audio processing is denoted by $N_{SB}$. The index used for these combined subbands or subband groups is g=1, . . . , $N_{SB}$.

The gth subband group is defined by a data set $G_g$ that contains the subband indices of the analysis filter bank 11. For example (cf. FIG. 1):

$$G_1=\{1\},\ G_2=\{2,3,4\},\ G_3=\{5,6,7,8\} \tag{1}$$

It is assumed that all subband groups cover all subbands of the original filter bank 11 in the frequency range from 0 Hz up to the Nyquist frequency. Therefore the subband groups are fully described by their bandwidths expressed in number of original filter bank subbands per subband group. These numbers for bandwidths are denoted by $B_{SB}[g]$, and the sum of all these bandwidths is equal to the number of bands of the original filter bank 11:

$$\Sigma_{g=1}^{N_{SB}} B_{SB}[g]=N_{FB}. \tag{2}$$

The values that need to be transferred to the decoder side are:

number of subband groups $N_{SB}$;

bandwidths of subband groups $B_{SB}[g]$ for g=1, . . . , $N_{SB}-1$, whereby the bandwidth of the last subband group needs not be transferred due to the above complete frequency range covering assumption.

The combination of these values is called subband configuration data.

Using equation (2), the bandwidth of the last subband group can be computed from the other bandwidths by $$B_{SB}[N_{SB}]=N_{FB}-\Sigma_{g=1}^{N_{SB}-1}B_{SB}[g]. \quad (3)$$

One way of coding the subband configuration could be as follows:

The number of used subband groups $N_{SB}$ is coded with a fixed number of bits $N_{b,SB}$. For determining this number of bits, a maximum number of subbands is defined. As an example $N_{b,SB}=5$ bits could be used for coding $N_{SB}\in[0,31]$.

The bandwidths $B_{SB}[g]$ for groups g=1, . . . , $N_{SB}-1$ are coded with $N_{b,BW}$ bits each. The maximum bandwidth of each subband group is $N_{FB}$ and the coding of the bandwidth would require $N_{b,BW}=\lceil\log_2(N_{FB})\rceil$ bits for each subband group.

As an example with $N_{FB}=64$, $N_{SB}=4$ and $N_{b,SB}=5$ this approach would require $N_{b,SB}+(N_{SB}-1)\cdot N_{b,BW}=5+3\cdot 6=23$ bits for transferring the subband configuration data.

Advantageously, the required number of bits for transferring a subband configuration can be reduced by using the following improved processing. It uses a value configIdx coded with 2 bits that describes three typical subband configurations for configIdx∈{0,1,2}. For configIdx=3 an adapted coding of the subband configuration data is used. For the three pre-defined subband configurations the following values are selected:

number of subband groups;

for each subband group the bandwidths of this subband group.

Table 1 shows an example of filter bank subband configurations for $N_{FB}=64$ encoded with a 2-bit value. Instead of $N_{FB}=64$, $N_{FB}=32$ or $N_{FB}=128$ can be used. The configurations with configIdx∈{0,1,2} are defined in the same way in both encoder and decoder. A zero value for $N_{SB}$ can also be used for indicating that the configuration data processing described below is not used at all. This way the corresponding coding tool can be disabled.

TABLE 1

| configIdx | numOfSubbandsTable[configIdx] (number of subband groups $N_{SB}$) | subbandWidthTable[configIdx] (subband group widths $B_{SB}$) |
|---|---|---|
| 0 | 0 | [ ] |
| 1 | 4 | [1 1 5 57] |
| 2 | 8 | [1 1 1 2 2 5 10 42] |
| 3 | defined by other coding scheme | |

Bandwidth Coding Adapted to Typical Subband Configurations

As mentioned above in connection with the Traunmüller and Zwicker/Fastl publications, there exist different scales (e.g. Bark scale) for the frequency axis that approximate the properties of human hearing. These frequency scales share the property of increasing subband widths with increasing frequency, such that at lower frequencies a better frequency resolution is obtained. The subband widths can be coded by transferring the bandwidth differences $$\Delta B_{SB}[g]=B_{SB}[g]-B_{SB}[g-1];\ g=2,\ldots,N_{SB}-1. \quad (4)$$

For the considered subband properties these bandwidth differences are then always non-negative.

Therefore, a subband configuration can also be defined by:

number of used subband groups $N_{SB}$;

bandwidth $B_{SB}[1]$ for the first subband group g=1;

bandwidth differences $\Delta B_{SB}[g]$ for subband groups g=2, . . . , $N_{SB}-1$.

From the bandwidth differences the bandwidths $B_{SB}[g]$ for subband groups g=2, . . . , $N_{SB}-1$ can be reconstructed, for instance as shown in table 4 following line CodedBwFirstSubband.

The last subband group bandwidth $B_{SB}[N_{SB}]$ can be reconstructed by using equation (3).

Statistical Analysis of Typical Subband Group Widths

For a statistical analysis of the subband group bandwidths and bandwidth differences, example subband configurations for a QMF filter bank with $N_{FB}=64$ subbands and with $N_{SB}=2, \ldots, 20$ subband groups that approximate a Bark scale were analysed. The subband groups were defined based on the conversion defined in the above-mentioned Traunmüller publication between z in Bark and f in Hz, which is given by $$z=\frac{26.81}{1+\frac{1960}{f}}-0.53 \quad (5)$$

$$f=\frac{1960}{\frac{26.81}{z+0.53}-1} \quad (6)$$

In more detail, the subband groups are obtained by:

creating equally spaced band edges on the Bark scale for the number of desired subband groups;

converting these values back to the frequency scale, which converted values are the desired band edges of the subband groups;

find centre frequencies of the original QMF subbands that lie inside the desired subbands;

do some postprocessing in order to achieve increasing bandwidths of the subband groups.

The resulting bandwidths of the subband groups, dependent on the number of subband groups, are given in table 2:

| $N_{SB}$ | $B_{SB}[1], \ldots, B_{SB}[N_{SB}-1]$ |
|---|---|
| 2 | [5] |
| 3 | [2 7] |
| 4 | [2 3 7] |

-continued

| $N_{SB}$ | $B_{SB}[1], \ldots, B_{SB}[N_{SB}-1]$ |
|---|---|
| 5 | [1 2 4 8] |
| 6 | [1 1 3 4 9] |
| 7 | [1 1 2 2 4 10] |
| 8 | [1 1 1 2 2 5 10] |
| 9 | [1 1 1 2 2 3 5 11] |
| 10 | [1 1 1 1 2 2 3 6 11] |
| 11 | [1 1 1 1 1 2 3 3 6 12] |
| 12 | [1 1 1 1 1 1 2 2 4 6 12] |
| 13 | [1 1 1 1 1 1 1 2 3 4 6 12] |
| 14 | [1 1 1 1 1 1 1 2 2 3 4 6 12] |
| 15 | [1 1 1 1 1 1 1 1 2 2 3 5 6 12] |
| 16 | [1 1 1 1 1 1 1 1 1 2 2 4 4 7 12] |
| 17 | [1 1 1 1 1 1 1 1 1 1 2 2 2 4 4 7 12] |
| 18 | [1 1 1 1 1 1 1 1 1 1 1 2 2 2 4 4 7 12] |
| 19 | [1 1 1 1 1 1 1 1 1 1 1 1 2 2 3 3 5 7 11] |
| 20 | [1 1 1 1 1 1 1 1 1 1 1 1 2 2 2 2 4 5 7 11] |

The bandwidth $B_{SB}[N_{SB}]$ is omitted in table 2 because it is the remaining bandwidth that adds up to a total bandwidth of 64 subbands.

Figure 2:
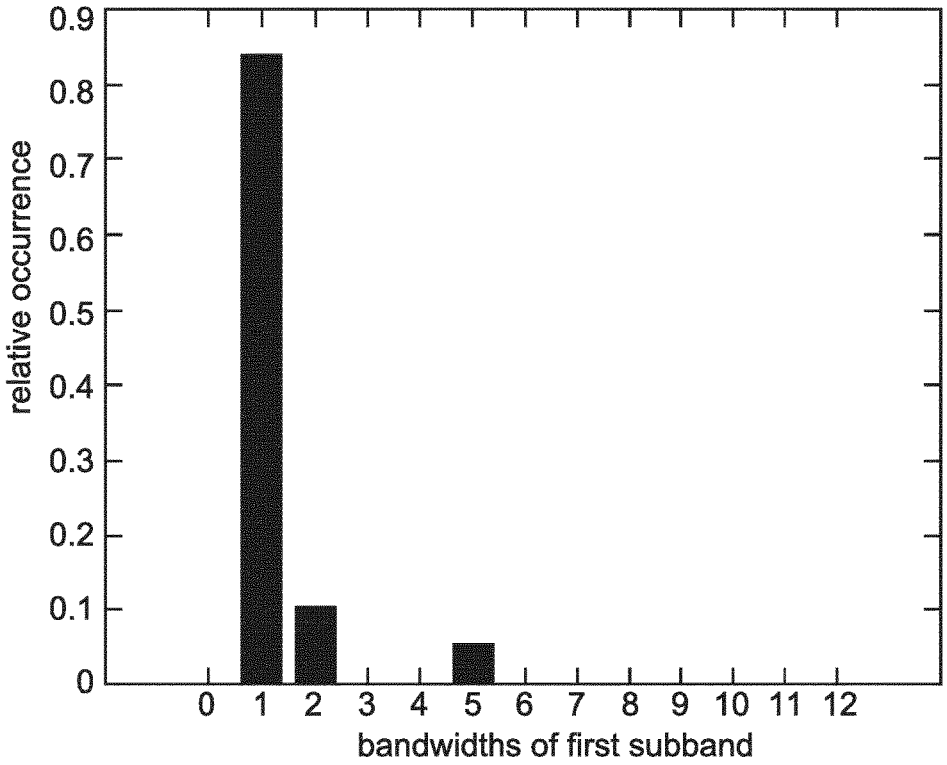
FIG. 2 histogram for the bandwidth of the first subband group $B_{SB}[1]$.

FIG. 2 depicts a histogram derived from table 2 of the subband group bandwidth differences of the first subband $B_{SB}[1]$ to be coded. There is a single bandwidth difference value of '5' for $N_{SB}=2$, and two bandwidth difference values of '2' for $N_{SB}=3$ and $N_{SB}=4$. All other bandwidth difference values are '1'. FIG. 2 shows that a unary code is well suited for coding because small values occur much more frequently than larger values. With a unary code the non-negative integer value n is encoded by n '1' bits followed by one '0' stop-bit.

Figure 3:
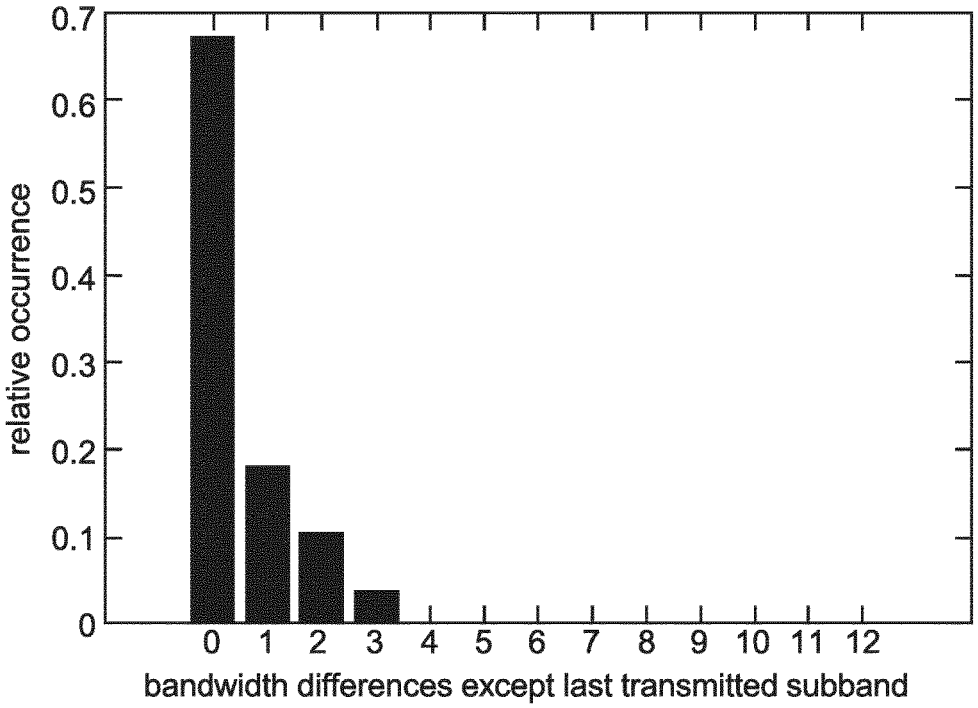
FIG. 3 histogram for the bandwidth differences $\Delta B_{SB}[g]$ for g=2, . . . , $N_{SB}-2$.

FIG. 3 depicts based on table 2 a histogram of the bandwidth differences $\Delta B_{SB}[g]$ for subband groups $g=2, \ldots, N_{SB}-2$, which again shows a distribution that is well suited for coding with a unary code.

Figure 4:
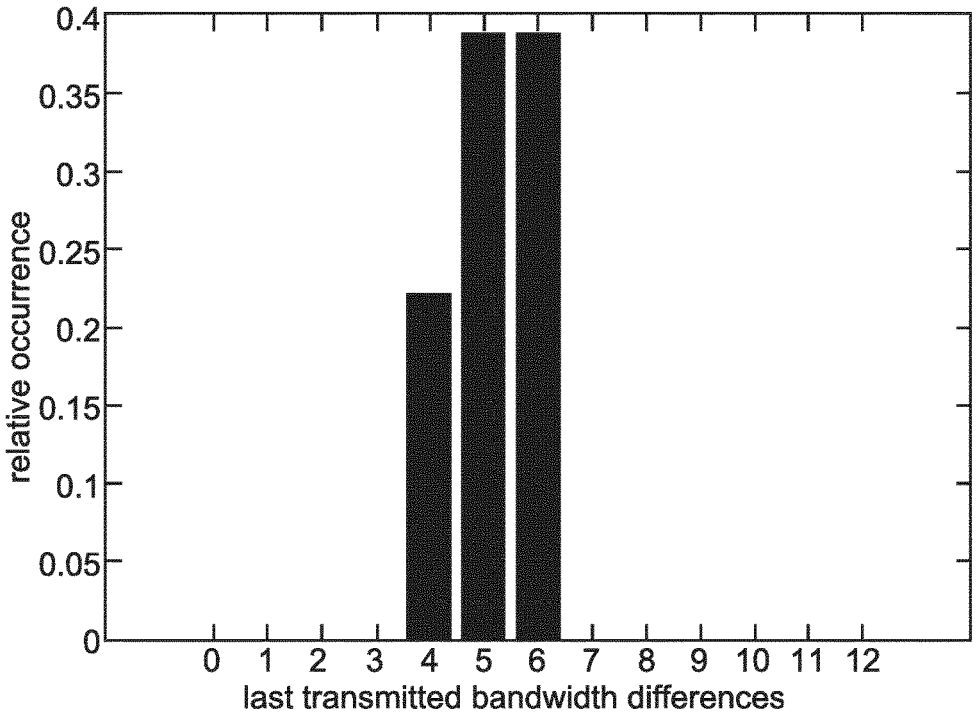
FIG. 4 histogram for the last transferred subband group bandwidth differences $\Delta B_{SB}[N_{SB}-1]$.

In FIG. 4 a histogram based on table 2 of last transferred subband group bandwidth differences $\Delta B_{SB}[N_{SB}-1]$ is shown. As this bandwidth difference is generally higher than for the previous subband groups, this value can be coded with a fixed number of bits which is termed $N_{b,lastDiff}$. In the considered case a width of $N_{b,lastDiff}=3$ bits is sufficient.

As mentioned above, for the last subband group $g=N_{SB}$ no bandwidth difference $\Delta B_{SB}[N_{SB}]$ needs to be transferred.

Improved Coding Processing

Based on the statistical analysis, the following improved coding processing is carried out:

coding of the number of subband groups:

$$\text{CodedNumberOfSubbands}=N_{SB}-1 \tag{7}$$

is coded with a fixed number of bits $N_{b,SB}$;

if the number of subband groups $N_{SB}$ is one, nothing else is transferred because this case is identical to a broadband processing;

coding of the bandwidth value $B_{SB}[1]$ of the first subband group. As $B_{SB}[1]\geq 1$, $$\text{CodedBwFirstSubband}=B_{SB}[1]-1 \tag{8}$$

is coded with a unary code;

the following bandwidth values need only be transferred if $N_{SB}>2$:

subband groups $g=2, \ldots, N_{SB}-2$: bandwidth difference values $\Delta B_{SB}[g]$ are each coded with a unary code;

subband group $g=N_{SB}-1$: the bandwidth difference value $\Delta B_{SB}[N_{SB}-1]$ is coded with a fixed number of bits $N_{b,lastDiff}$;

subband group $g=N_{SB}$: no value or coded value is transferred.

The coding scheme bitstream syntax is shown in table 3 as pseudo-code for transfer of subband configuration data. Data in bold are written to the bitstream and represent a subband configuration data block ($s_{SBconfig}$)

| Syntax | No. of bits | Type |
|---|---|---|
| **configIdx** | 2 | unsigned int |
| if (configIdx == 3) { | | |
| **CodedNumberOfSubbands** (i.e. $N_{SB}-1$) | $N_{b,SB}$ | unsigned int |
| if (CodedNumberOfSubbands > 0) { | | |
| **CodedBwFirstSubband** | (dynamic) | unary code |
| if (CodedNumberOfSubbands > 1) { | | |
| if (CodedNumberOfSubbands > 2) { | | |
| for g = 2 to $N_{SB}-2$ { | | |
| $\mathbf{\Delta B_{SB}[g]}$ | (dynamic) | unary code |
| } | | |
| } | | |
| $\mathbf{\Delta B_{SB}[N_{SB}-1]}$ | $N_{b,lastDiff}$ | unsigned int |
| } | | |
| } | | |
| } | | |

The inventors have found that, for $N_{FB}=64$, sufficient bit widths (i.e. word lengths) are $N_{b,SB}=5$ and $N_{b,lastDiff}=3$.

Table 4 shows decoding of the transferred subband configuration data, by reading these data from the bitstream received at decoder side (data in bold are read from the bitstream), and reconstruction of the bandwidth values $B_{SB}[g]$:

| Syntax | No. of bits | Type |
|---|---|---|
| **configIdx** | 2 | unsigned int |
| if (configIdx < 3) { | | |
| $N_{SB}$ = numOfSubbandsTable[configIdx] | | |
| $B_{SB}$ = subbandWidthTable[configIdx] | | |
| } | | |
| else { | | |
| **CodedNumberOfSubbands** | $N_{b,SB}$ | unsigned int |
| $N_{SB}$ = CodedNumberOfSubbands + 1 | | |
| $B_{total}=0$ | | |
| if ($N_{SB}>1$) { | | |
| **CodedBwFirstSubband** | (dynamic) | unary code |
| $B_{SB}[1]$ = CodedBwFirstSubband + 1 | | |
| $B_{total}=B_{total}+B_{SB}[1]$ | | |
| if ($N_{SB}>2$) { | | |
| if ($N_{SB}>3$) { | | |
| for g = 2 to $N_{SB}-2$ { | | |
| $\mathbf{\Delta B_{SB}[g]}$ | (dynamic) | unary code |
| $B_{SB}[g]=\Delta B_{SB}[g]+B_{SB}[g-1]$ | | |
| $B_{total}=B_{total}+B_{SB}[g]$ | | |
| } | | |
| } | | |
| $g=N_{SB}-1$ | | |
| $\mathbf{\Delta B_{SB}[g]}$ | $N_{b,lastDiff}$ | unsigned int |
| $B_{SB}[g]=\Delta B_{SB}[g]+B_{SB}[g-1]$ | | |
| $B_{total}=B_{total}+B_{SB}[g]$ | | |
| } | | |
| } | | |
| $B_{SB}[N_{SB}]=N_{FB}-B_{total}$ | | |
| } | | |

The reconstruction of subband index set $G_g$ from the reconstructed bandwidth values $B_{SB}[g]$ for all subband groups is shown in pseudo code in table 5:

```
i = 0
for g = 1 to N_SB {
  G_g = { }
```

-continued

```
    for b = 1 to B_SB[g] {
      i = i + 1
      G_g = G_g ∪ {i}
    }
  }
```

Results for the Improved Coding Processing

Figure 5:
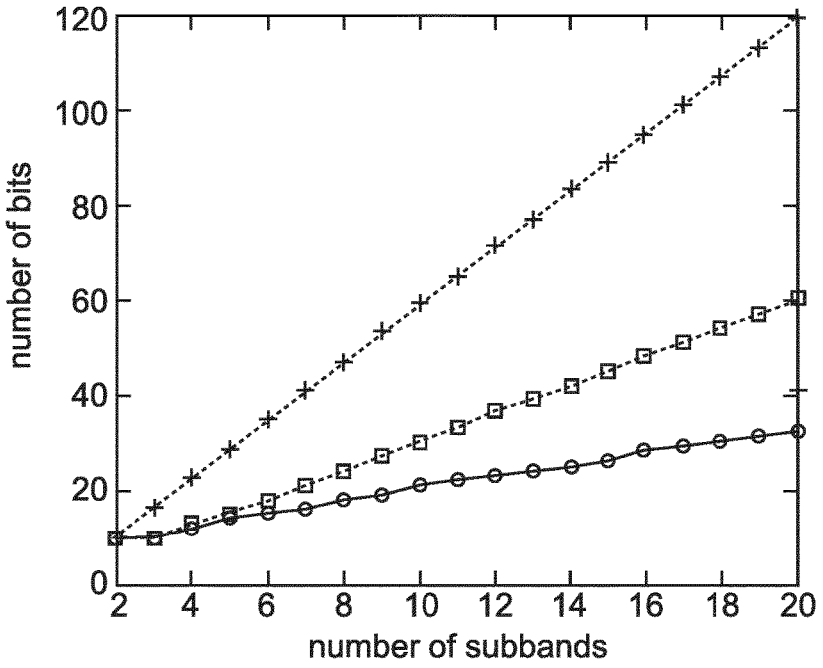
FIG. 5 number of bits required for transmission of subband configuration data for different number of subbands.

The number of required bits for coding the subband configurations is simulated for a QMF filter bank with $N_{FB}$=64 subbands and with $N_{SB}$=2, . . . , 20 subband groups with the configurations given in table 2. FIG. 5 shows for the considered numbers of subband groups the resulting number of bits for different ways of coding the subband configuration. The result for the improved coding processing is shown as circles, and is compared with two alternative approaches: coding of the bandwidth differences with a fixed number of 3 bits each (shown by squares) and coding of the bandwidths with a fixed number of 6 bits each (shown by plus signs).

In comparison with the total of 23 bits example in the paragraph following equation (3), the improved processing requires 12 bits only.

The improved subband configuration coding processing clearly outperforms the alternative approaches.

Figure 6:
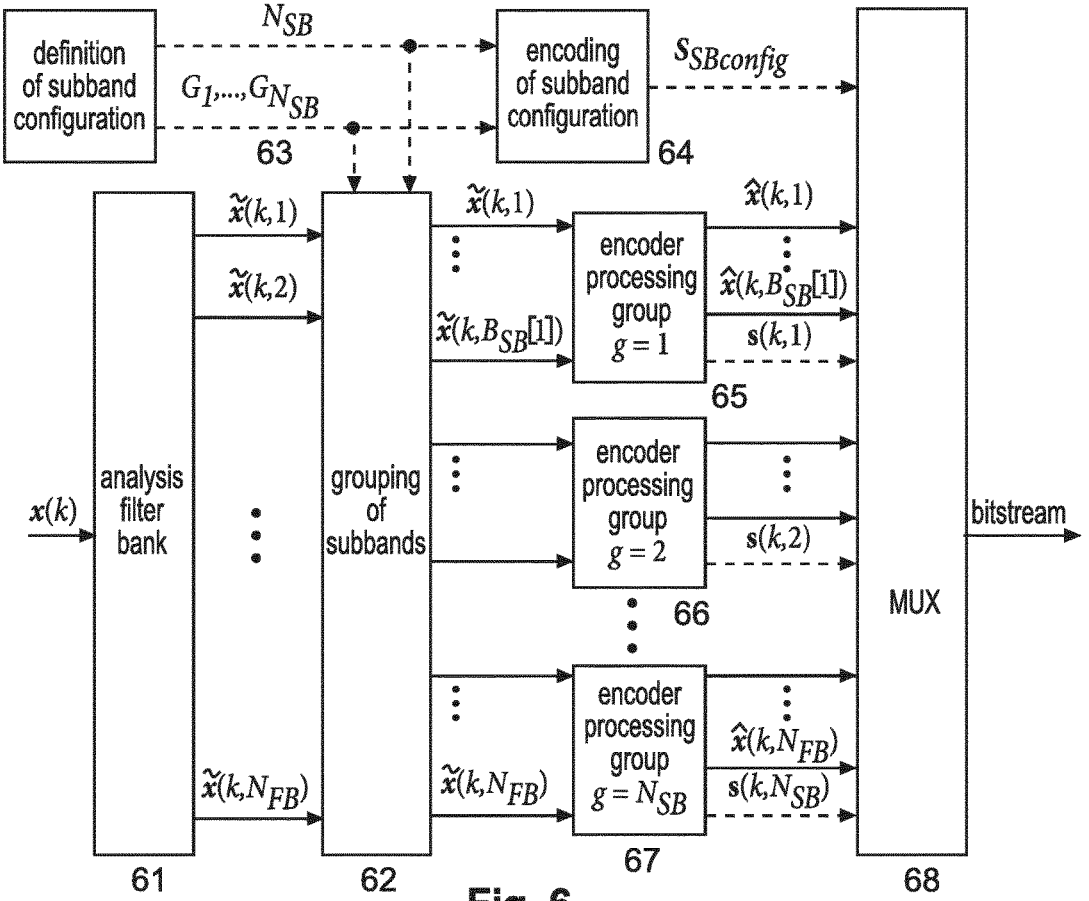
FIG. 6 example encoder block diagram.
Figure 7:
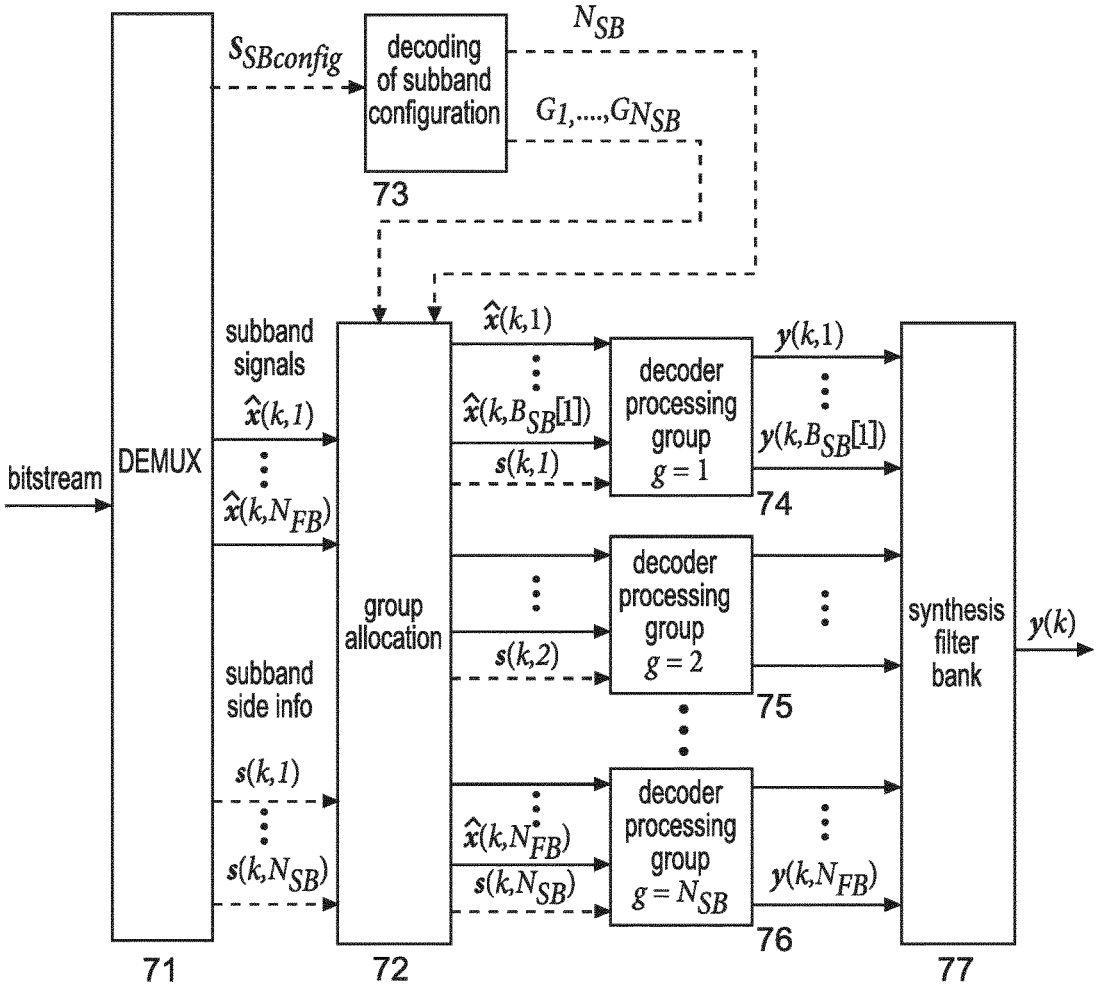
FIG. 7 example decoder block diagram.

An example encoder including generation of corresponding encoded subband configuration data is shown in FIG. 6, and a corresponding decoder including a decoder for the encoded subband configuration data is shown in FIG. 7. In these figures solid lines indicate signals and dashed lines indicate side information data. Index k denotes the frame index over time and the input signal x(k) is a vector containing the samples of current frame k.

In FIG. 6 the audio input signal x(k) is fed to an analysis filter bank step or stage 61, from which $N_{FB}$ subband signals are obtained which are denoted in vector notation as $\tilde{x}(k,i)$ with frame index k and subband index i. In case the analysis filter bank 61 applies downsampling of the subband signals, the length of the subband signal vectors is smaller than the length of the input signal vector. In step or stage 63 the desired subband configuration is defined (e.g. based on the current psycho-acoustical properties of the input signal x(k)), and corresponding values $N_{SB}$ and $G_1, \ldots, G_{N_{SB}}$ are output to a subband grouping step or stage 62 and to a subband configuration data encoding step or stage 64. According to the chosen subband configuration the grouping of the subband signals is carried out in subband grouping step/stage 62. The gth group contains all subbands with $i \in G_g$. For example, the first subband group contains subband signals $\tilde{x}(k,1), \ldots, \tilde{x}(k,B_{SB}[1])$, and the highest subband signal in the highest subband group is $\tilde{x}(k,N_{FB})$. For each subband group the processed and quantised subband signals $\hat{x}(k,i)$ and the corresponding side information s(k,g) are computed in corresponding encoder processing steps or stages 65 (group g=1), 66 (group g=2), . . . , 67 (group $g=N_{SB}$). The encoded subband configuration data $s_{SBconfig}$ encoded in step/stage 64 as described above, the processed subband signals $\hat{x}(k,1), \ldots, \hat{x}(k,N_{FB})$ and the corresponding side information data $s(k,1), \ldots, s(k,N_{SB})$ per subband group are multiplexed in a multiplexer step or stage 68 into a bitstream, which can be transferred to a corresponding decoder. The coded subband configuration data needs not be transferred for every frame, but only for frames where a decoding can be started or where the subband configuration is changing.

In the decoder in FIG. 7 the data from the received bitstream are demultiplexed in a demultiplexer step or stage 71 into encoded subband configuration data $s_{SBconfig}$, processed subband signals $\hat{x}(k,1), \ldots, \hat{x}(k,N_{FB})$ and the corresponding side information data $s(k,1), \ldots, s(k,N_{SB})$ per subband group. The encoded subband configuration data is decoded in step or stage 73 as described above, which results in corresponding values $N_{SB}$ and $G_1, \ldots, G_{N_{SB}}$. Using this decoded subband configuration data, the allocation of the transferred subband signals and the subband group side information to the subband groups is performed in step or stage 72, which outputs e.g. for group g=1 $\hat{x}(k,1), \ldots, \hat{x}(k,B_{SB})$ and s(k,1). Thereafter, the decoder processing of all subband groups is carried out in decoders 74, 75, . . . , 76 by using the corresponding side information for each subband group. For example, the first output subband group contains subband signals $y(k,1), \ldots, y(k,B_{SB}[1])$, and the highest subband signal in the highest subband group is $y(k,N_{FB})$. Finally a synthesis filter bank step or stage 77 reconstructs therefrom the decoded audio signal y(k).

In a different embodiment the original subbands do not have equal widths. Further, instead of having a number of original subbands that is a power of '2', any other integer numbers of original subbands could be used. In both cases the described processing can be used in a corresponding manner.

In a further embodiment a compressed audio signal contains multiple sets of different subband configuration data encoded as described above, which serve for applying different coding tools used for coding that audio signal, e.g. directional signal parts and ambient signal parts of a Higher Order Ambisonics audio signal or any other 3D audio signal, or different channels of a multi-channel audio signal.

In a further embodiment the processed subband signals $\hat{x}(k,i)$ may not be transferred to the decoder side, but at decoder side the subband signals are computed by an analysis filter bank from another transferred signal. Then the subband group side information s(k,g) is used in the decoder for further processing.

The described processing can be carried out by a single processor or electronic circuit, or by several processors or electronic circuits operating in parallel and/or operating on different parts of the complete processing.

The instructions for operating the processor or the processors according to the described processing can be stored in one or more memories. The at least one processor is configured to carry out these instructions.

The invention claimed is:

1. A non-transitory medium having instructions stored thereon for controlling one or more processors to perform a method for coding audio subband configuration data ($N_{SB}$, $G_1 \ldots G_{N_{SB}}$) for audio subband groups (g) for one or more frames of an audio signal, said method comprising:

coding a number of audio subband groups $N_{SB}$ with a fixed number of bits ($N_{b,SB}$) representing $N_{SB}-1$;

coding, based on a determination that $N_{SB}>1$, for a first audio subband group g=1 a bandwidth value $B_{SB}[1]$ with a unary code representing $B_{SB}[1]-1$;

coding, based on a determination that $N_{SB}=3$, for audio subband group g=2 a bandwidth difference value $\Delta B_{SB}[2]=B_{SB}[2]-B_{SB}[1]$ with a fixed number of bits ($N_{b,lastDiff}$);

coding, based on a determination that $N_{SB}>3$, for audio subband groups g=2, . . . , $N_{SB}-2$ a corresponding number of bandwidth difference values $\Delta B_{SB}[g]=B_{SB}[g]-B_{SB}[g-1]$ with a unary code, and coding for audio subband group $g=N_{SB}-1$ a bandwidth difference value $\Delta B_{SB}[N_{SB}-1]=B_{SB}[N_{SB}-1]-B_{SB}[N_{SB}-2]$ with a fixed number of bits ($N_{b,lastDiff}$), wherein a bandwidth value for an audio subband group is based on a number of adjacent original audio subbands, and wherein no corresponding value is included in the coded audio subband configuration data based on a determination that audio subband $g=N_{SB}$.

2. A non-transitory medium according to claim 1, wherein an audio subband configuration data block ($s_{SBconfig}$) includes a configuration value (configIdx) that determines whether:

a first combination of number of audio subband groups and related audio subband group widths represents said audio subband configuration data, or a different second combination of number of audio subband groups and related audio subband group widths represents said audio subband configuration data, or further combinations of number of audio subband groups and related audio subband group widths represent said audio subband configuration data, or audio subband configuration data are coded according to the method of claim 1, wherein no audio subband configuration data is generated based on a determination that $N_{SB}=0$.

3. A non-transitory storage medium that contains or stores, or has recorded on it, a digital compressed audio signal that contains audio subband configuration data encoded according to the method of claim 1.

4. A non-transitory storage medium that contains or stores, or has recorded on it, a digital compressed audio signal that contains multiple sets of different audio subband configuration data encoded according to the method of claim 1.

5. An apparatus for coding audio subband configuration data ($N_{SB}$, $G_1 \ldots G_{N_{SB}}$) for audio subband groups (g) said apparatus comprising: at least one or more processors;

an encoder configured to code a number of audio subband groups $N_{SB}$ with a fixed number of bits ($N_{b,SB}$) representing $N_{SB}-1$, the encoder further configured to:

code, based on a determination that $N_{SB}>1$, for a first audio subband group g=1 a bandwidth value $B_{SB}[1]$ with a unary code representing $B_{SB}[1]-1$;

code, based on a determination that $N_{SB}=3$, for audio subband group g=2 a bandwidth difference value $\Delta B_{SB}[2]=B_{SB}[2]-B_{SB}[1]$ with a fixed number of bits ($N_{b,lastDiff}$);

code, based on a determination that $N_{SB}>3$, for audio subband groups $g=2, \ldots, N_{SB}-2$ a corresponding number of bandwidth difference values $\Delta B_{SB}[g]=B_{SB}[g]-B_{SB}[g-1]$ with a unary code, and coding for audio subband group $g=N_{SB}-1$ a bandwidth difference value $\Delta B_{SB}[N_{SB}-1]=B_{SB}[N_{SB}-1]-B_{SB}[N_{SB}-2]$ with a fixed number of bits ($N_{b,lastDiff}$), wherein a bandwidth value for an audio subband group is based on a number of adjacent original audio subbands, and wherein no corresponding value is included in the coded audio subband configuration data based on a determination that audio subband $g=N_{SB}$.

6. An apparatus according to claim 5, wherein the encoder is further configured to include an audio subband configuration data block ($s_{SBconfig}$) includes a configuration value (configIdx) that determines whether:

a first combination of number of audio subband groups and related audio subband group widths represents said audio subband configuration data, or a different second combination of number of audio subband groups and related audio subband group widths represents said audio subband configuration data, or further combinations of number of audio subband groups and related audio subband group widths represents said audio subband configuration data, or audio subband configuration data are coded according to the encoder configuration of claim 5, wherein no audio subband configuration data is generated based on a determination that $N_{SB}=0$.

7. A non-transitory medium having instructions stored thereon for controlling one or more processors to perform a method for decoding coded audio subband configuration data ($s_{SBconfig}$) for audio subband groups (g) valid for one or more frames of a coded audio signal, the method comprising:

determining a number of audio subband groups $N_{SB}$ based on a decoded version of a coded number of audio subband groups;

determining for a first audio subband group g=1 a bandwidth value $B_{SB}[1]$ based on a decoded version of the corresponding coded bandwidth value;

decoding a group g, wherein, based on a determination that $N_{SB}=3$, for an audio subband group g=2 decoding from a coded version of bandwidth difference value $\Delta B_{SB}[2]$ a bandwidth value $B_{SB}[2]=\Delta B_{SB}[2]+B_{SB}[1]$, and wherein, based on a determination that $N_{SB}>3$, for audio subband groups $g=2, \ldots, N_{SB}-2$ decoding from a coded version of bandwidth difference values $\Delta B_{SB}[g]$ bandwidth values $B_{SB}[g]=\Delta B_{SB}[g]+B_{SB}[g-1]$, and decoding for audio subband group $g=N_{SB}-1$ from a coded version of bandwidth difference value $\Delta B_{SB}[N_{SB}-1]$ a bandwidth value $B_{SB}[N_{SB}-1]=\Delta B_{SB}[N_{SB}-1]+B_{SB}[N_{SB}-2]$; and determining a bandwidth value $B_{SB}[N_{SB}]$ for subband $g=N_{SB}$ by subtracting the bandwidths $B_{SB}[1]$ to $B_{SB}[N_{SB}-1]$ from $N_{FB}$, wherein a bandwidth value for an audio subband group is based on a number of adjacent original audio subbands.

8. A non-transitory medium according to claim 7, wherein the decoding is based on an audio subband configuration data block ($s_{SBconfig}$) that includes a configuration value (configIdx) that indicates whether:

a first combination of number of audio subband groups and related audio subband group widths represents said audio subband configuration data, or a different second combination of number of audio subband groups and related audio subband group widths represents said audio subband configuration data, or further combinations of number of audio subband groups and related audio subband group widths represent said audio subband configuration data, or audio subband configuration data were coded according to the method of claim 1.

9. The non-transitory medium of claim 7, wherein the number of audio subband groups $N_{SB}$ is determined by adding '1' to the decoded version of the coded number of audio subband groups.

10. An apparatus for decoding coded audio subband configuration data ($s_{SBconfig}$) for audio subband groups (g) valid for one or more frames of a coded audio signal, the apparatus comprising: at least one or more processors;

a decoder configured to determine a number of audio subband groups $N_{SB}$ based on a decoded version of coded number of audio subband groups, the decoder further configured to determine, for a first audio subband group g=1 a bandwidth value $B_{SB}[1]$ based on a decoded version of the corresponding coded bandwidth value, wherein based on a determination that $N_{SB}=3$, the decoder is further configured to decode, for audio subband group g=2 from the coded version of bandwidth difference value $\Delta B_{SB}[2]$ a bandwidth value $B_{SB}[2]=\Delta B_{SB}[2]+B_{SB}[1]$, and wherein, based on a determination that $N_{SB}>3$, for said first audio subband group g=1, the decoder is further configured to decode, for audio subband groups $g=2, \ldots, N_{SB}-2$ from the coded version of bandwidth difference values $\Delta B_{SB}[g]$ bandwidth values $B_{SB}[g]=\Delta B_{SB}[g]+B_{SB}[g-1]$, and to decode for audio subband group $g=N_{SB}-1$ from the coded version of bandwidth difference value $\Delta B_{SB}[N_{SB}-1]$ a bandwidth value $B_{SB}[N_{SB}-1]=\Delta B_{SB}[N_{SB}-1]+B_{SB}[N_{SB}-2]$, wherein the decoder is further configured to determine a bandwidth value $B_{SB}[N_{SB}]$ for audio subband $g=N_{SB}$ by subtracting the bandwidths $B_{SB}[1]$ to $B_{SB}[N_{SB}-1]$ from $N_{FB}$, and wherein a bandwidth value for an audio subband group is based on a number of adjacent original audio subbands.

11. An apparatus according to claim 10, wherein the decoder is further configured to include an audio subband configuration data block ($s_{SBconfig}$) that includes a configuration value (configIdx) that indicates whether:

a first combination of number of audio subband groups and related audio subband group widths represents said audio subband configuration data, or a second predefined combination of number of audio subband groups and related audio subband group widths represents said audio subband configuration data, or further combinations of number of audio subband groups and related audio subband group widths represent said audio subband configuration data, or audio subband configuration data were coded according to the method of claim 1.

12. The apparatus of claim 10, wherein decoder is configured to determine the number of audio subband groups $N_{SB}$ by adding '1' to the decoded version of the coded number of audio subband groups.

* * * * *